US007131719B2

(12) United States Patent
Takagi et al.

(10) Patent No.: US 7,131,719 B2
(45) Date of Patent: Nov. 7, 2006

(54) INKJET PRINTER

(75) Inventors: Osamu Takagi, Nagoya (JP); Susumu Kuzuya, Gifu (JP); Yasuhiro Shimizu, Mizuho (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 249 days.

(21) Appl. No.: 10/795,349

(22) Filed: Mar. 9, 2004

(65) Prior Publication Data

US 2004/0227793 A1 Nov. 18, 2004

(30) Foreign Application Priority Data

Mar. 28, 2003 (JP) ..... 2003-092170

(51) Int. Cl.
*B41J 2/175* (2006.01)
*B65H 3/06* (2006.01)

(52) U.S. Cl. ..... 347/85; 271/114

(58) Field of Classification Search ..... 347/84, 347/85, 29, 30, 32–33; 271/114; 400/184, 400/185, 186, 187, 370, 371
See application file for complete search history.

(56) References Cited

U.S. PATENT DOCUMENTS 5,434,605 A * 7/1995 Osborne ..... 347/23
6,033,060 A 3/2000 Minami
6,130,684 A * 10/2000 Premnath et al. ..... 347/30
6,168,268 B1 1/2001 Sugiyama
6,460,967 B1 * 10/2002 Makita et al. ..... 347/33
6,491,368 B1 * 12/2002 Cipolla et al. ..... 347/23
6,536,864 B1 3/2003 Kan
2001/0017636 A1 8/2001 Kan
2003/0007031 A1 1/2003 Sugiyama

FOREIGN PATENT DOCUMENTS

JP 10-202904 A 8/1998
JP A 2001-310459 11/2001

* cited by examiner

*Primary Examiner*—Anh T. N. Vo
(74) *Attorney, Agent, or Firm*—Oliff & Berridge, PLC

(57) ABSTRACT

An inkjet printer includes inkjet heads, pumps, a drive source, a derive shaft, power transmission mechanisms, and a selection unit. The pumps supply ink to the inkjet heads to recover an ink ejection condition of the inkjet heads. The drive source rotates the drive shaft forward or backward. The power transmission mechanisms are disposed between the drive shaft and the pumps, respectively, and switch between a state where a forward rotation force of the drive shaft is transmitted to each pump to bring each pump in a operatable condition and a state where the forward rotation force of the drive shaft is not transmitted to each pump. In conjunction with reverse rotation of the drive shaft, the selection unit selects at least one of the power transmission mechanisms to be brought into a state where the selected power transmission mechanism transmits the forward rotation force of the drive shaft.

8 Claims, 9 Drawing Sheets

INKJET PRINTER

BACKGROUND OF THE INVENTION

1. Field of the Invention

The present invention relates to an inkjet printer that performs the purge operation.

2. Description of the Related Art

In a conventional inkjet printer for ejecting ink from an inkjet head having a group of inkjet nozzles to form an image on a sheet of paper, any inkjet nozzles may be clogged due to ink left away to increase the viscosity of the ink or air bubbles or dust adhering to an inner wall face of an ink flow passage.

Thus, there has been known an inkjet printer that performs an operation for discharging ink at a high pressure from the inkjet nozzles (a so-called purge operation) to recover and maintain an ink discharge condition in the inkjet nozzles.

For example, an inkjet printer performs the purge operation in which ink within the inkjet nozzles is discharged together with air bubbles and dust by producing a large negative pressure using a pump connected to a suction cap and sucking through the suction cap in a state where the suction cap is contacted with a nozzle face to which a group of nozzles of the inkjet head are opened (e.g., refer to JP-A-2001-310459).

Besides, another inkjet printer performs the purge operation in which the ink is discharged from the inkjet nozzles by pressurizing ink supplied to the inkjet nozzles using the pump and supplying the ink at a high pressure to the inkjet nozzles.

SUMMARY OF THE INVENTION

By the way, in an inkjet printer in which a plurality of inkjet heads having a group of inkjet nozzles are provided corresponding to the number of colors, the purge operation for all the inkjet heads is performed by one pump at the same time.

On the other hand, in the inkjet printer having a plurality of inkjet heads, the case where the ink jet nozzles are clogged includes the following cases. In one case, of the plurality of the inkjet heads, the inkjet heads for all colors are clogged. Alternatively, in another case, the ink jet head for a single color is clogged.

However, in the conventional inkjet printer, even when one inkjet head is clogged, the purge operation is performed for all the inkjet heads. Therefore, the ink is discharged from unnecessary inkjet heads in the purge operation, causing a problem of wasting the ink.

To prevent this problem, it is necessary to provide a pump and a drive source for driving the pump for each inkjet head, thereby driving the drive source for the inkjet head requiring the purge operation. However, if the drive source is provided for each inkjet head, the device has unfavorably a larger size with the cost increased.

This invention has been achieved in the light of the above-mentioned problems. It is an object of the invention to provide an inkjet printer including a plurality of inkjet heads in which at least one of the plurality of inkjet heads is arbitrarily selected and purged by one drive source.

In order to achieve the above object, according to an embodiment of the invention, an inkjet printer includes a plurality of inkjet heads, a plurality of pumps, a drive source, a first drive shaft, a plurality of power transmission mechanisms, and a selection unit. The plurality of inkjet heads eject ink to form an image on a recording medium, respectively. The plurality of pumps supply the ink to the inkjet heads to recover an ejection condition of the ink of the inkjet heads. The first drive shaft is rotated forward or backward by the drive source. The plurality of first power transmission mechanisms are disposed between the first drive shaft and the pumps, respectively and switch between a state where a forward rotation force of the first drive shaft is transmitted to each pump to bring each pump in a operatable condition and a state where the forward rotation force of the first drive shaft is not transmitted to each pump. The selection unit, in conjunction with reverse rotation of the first drive shaft, selects at least one of the first power transmission mechanisms to be brought into a state where the selected first power transmission mechanism transmits the forward rotation force of the first drive shaft.

DETAILED DESCRIPTION OF THE PREFERRED EMBODIMENT

Figure 1:
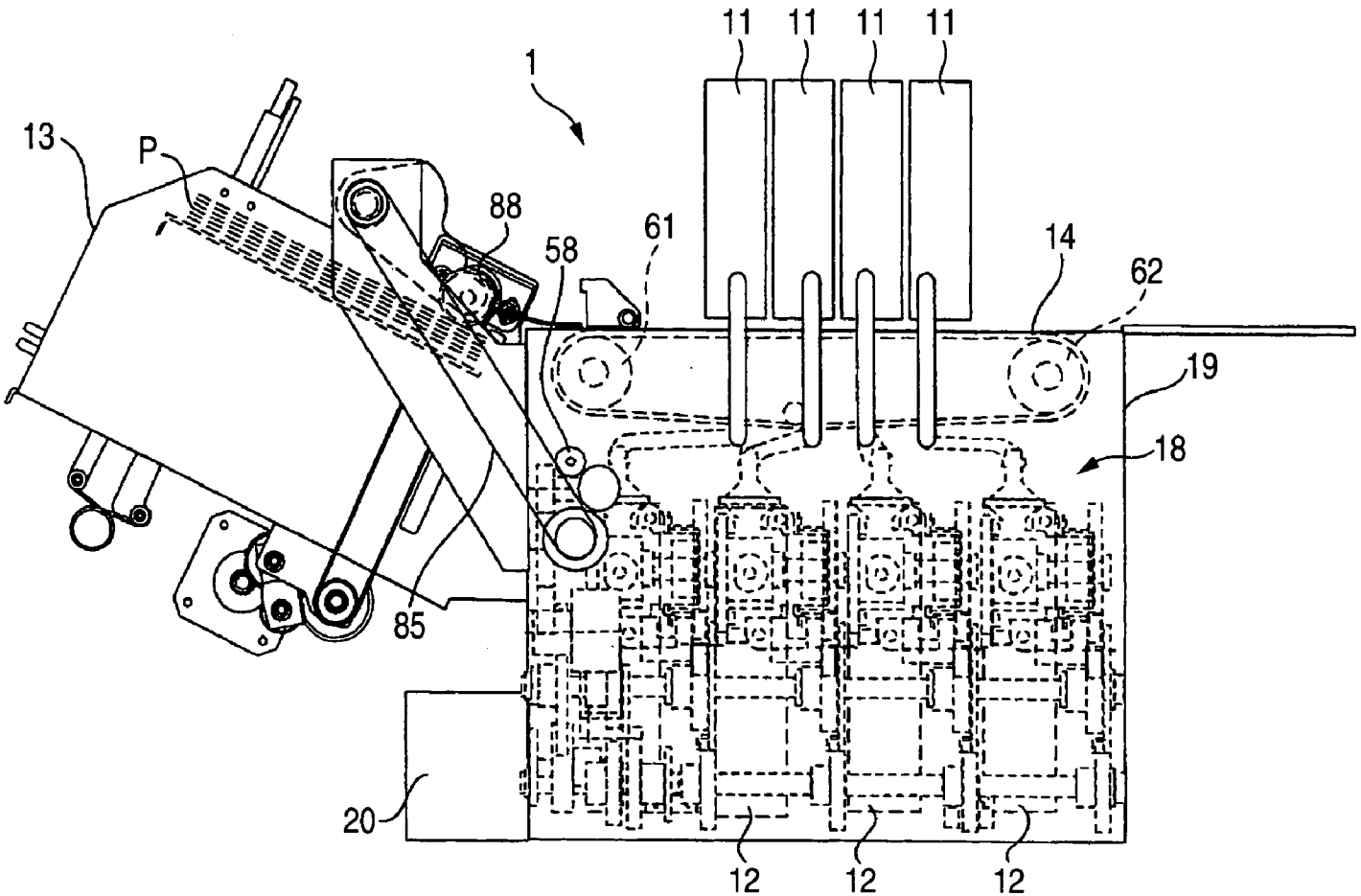
FIG. 1 is a schematic side view showing the overall internal constitution of an ink jet printer 1 according to an embodiment of the invention.

The preferred embodiments of the present invention will be described below with reference to the accompanying drawings. FIG. 1 is a schematic side view showing the overall internal structure of an inkjet printer 1 according to an embodiment of the invention.

As shown in FIG. 1, the inkjet printer 1 includes four ink cartridges 12 (partly shown in FIG. 1), four ink jet heads 11, a paper feeding portion 13, a paper transporting belt 14, a purge portion 18, and a control portion 110. The ink cartridges 12 stores four color inks of cyan, magenta, yellow and black, respectively. The four inkjet heads 11 prints the color inks on the sheet of paper P. The paper feeding portion 13 feeds the sheet of paper P. The paper transporting belt 14 transports the sheet of paper P from the paper feeding portion 13 to the inkjet heads 11. The purge portion 18 performs the purge operation for applying pressure to ink to discharge the ink from ink ejection port of the inkjet head 11. The control portion 110 controls the overall operation of the inkjet printer.

Each of inkjet heads 11 includes a group of inkjet nozzles. Vibration of each piezoelectric element generates pressure wave in each ink jet nozzle, whereby each nozzle ejects the ink. A number of ejection ports for discharging the ink are arranged over the width of the sheet of paper P in a direction orthogonal to the transporting direction of the sheet of paper P. The ink stored in the ink cartridges 12 are sucked and the ink corresponding to one row of the sheet of paper P in the width direction are ejected at a time to form an image on the sheet of paper P. Thereby, the high speed printing is effected. Also, the inkjet head 11 includes a cap portion 15 (not shown) for covering the ejection ports of the inkjet head 11 when not in use for the printing. During the purge operation, this cap portion 15 also covers the ejection ports of the inkjet head 11 to recover the ink discharged by the purge operation.

In the inkjet printer of this type, a large quantity of ink is discharged from the inkjet head and the ink consumed in the purge operation are also large quantity. If at least one of the plurality of inkjet heads 11 is arbitrarily selected and the purge operation is operated therefor, there is the significant effect that unnecessary purge operation is eliminated and the ink is not wasted.

Also, the paper feeding portion 13 stores the sheets of paper P stacked, and includes a pickup roller 88 for picking up and supplies the sheets of paper P stored therein to the inside of the inkjet printer one by one. When a gear 58 disposed in a housing 19 of the inkjet printer 1 rotates, the rotation force is transmitted through a power transmission belt 85 to rotate the pickup roller 88, thereby feeding the sheet of paper P to the paper transporting belt 14.

Also, the paper transporting belt 14 has a degree of stickiness on a surface thereof to hold the sheet of paper P during the transportation without causing slip of the sheet of paper P. The paper transporting belt 14 is wound around a drive roller 61 and a driven roller 62. When the drive roller 61 rotates, the paper transporting belt 14 passes the sheet of paper P fed from the paper feeding portion 13, beneath the inkjet heads 11, as shown in FIG. 1.

With this configuration, in the inkjet printer 1, when image data is input from the outside such as a personal computer, the control portion 110 drives a motor 20 to rotate the gear 58 and rotate the pickup roller 88, so that one sheet of paper P is fed onto the paper transporting belt 14. The drive roller 61 drives the paper transporting belt 14 to feed the sheet of paper P just under the inkjet heads 11. The ink supplied from the ink cartridge 12 is ejected from the inkjet head 11 in accordance with the image data to form an image on the sheet of paper P, as shown in FIG. 3.

As shown in FIG. 2, the purge portion 18 includes four pumps 40, the motor 20, a drive shaft 24, and a selection shaft 30.

Figure 3:
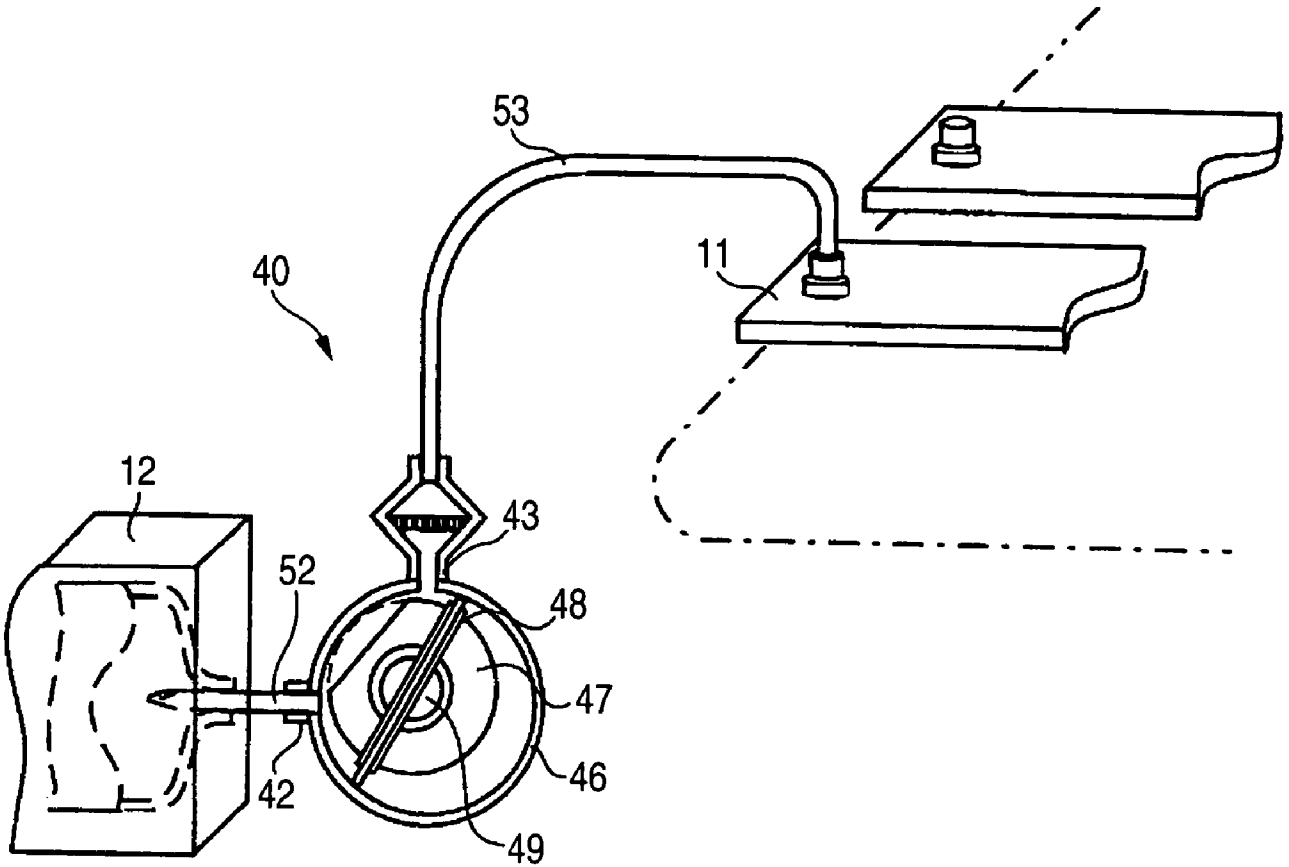
FIG. 3 is a view showing the operation of a pump 40 in this embodiment.

Herein, as shown in FIG. 3, the pump 40 includes a cylinder 46 having a substantially tubular shape, a rotor 47, and a sliding portion 48. The cylinder 46 includes a suction opening 42 and an exhaust opening 43. The rotor 47 disposed in the cylinder 46. The sliding portion 48 is provided slidably within the rotor 47 and functions as a rectangular plate for partitioning the cylinder 46. A needle 52 communicates the suction opening 42 with the ink cartridge 12. A tube 53 communicates the exhaust opening 43 with the inkjet head 11.

Also, the rotor 47 has a substantially columnar shape, and is mounted so that the rotor 47 rotates while a side face of the columnar shape is in contact with an inner side face of the cylinder 46 between the suction opening 42 and the exhaust opening 43. The rotor 47 includes a drive shaft 49 connected to an outside gear 41 at the center of the rotational shaft thereof.

Also, the sliding portion 48 includes a plate member. The sliding portion 48 is mounted in a groove extending through the center of the rotational shaft of the rotor 47 and rotates along with the rotor 47. The sliding portion 48 is always in contact with the inner face of the cylinder 46 and partitions the inside of the cylinder 46 into two parts. Since the central position of the cylinder 46 and the central position of the rotor 47 are unmatched, the percentage of the volumes partitioned by the sliding portion 48 is changed depending on an angular position of the rotor 47.

In the pump 40 as configured in the above manner, when the rotor 47 rotates counterclockwise in FIG. 3, the volume on a side communicating with the suction opening 42 inside the cylinder 46 partitioned by the sliding portion 48 increases as the rotor 47 rotates. Therefore, an internal portion of the suction opening 42 is placed in a negative pressure, so that the ink is sucked through the suction opening 42. Conversely, the volume on the other side communicating with the exhaust opening 43 inside the cylinder 46 partitioned by the sliding portion 48 decreases as the rotor 47 rotates. Therefore, the ink within the cylinder 46 is compressed and discharged through the exhaust opening 43. That is, the pump 40 operates as what is called a rotary pump.

The rotor 47 has a cylindrical shape that is partially cut away. If the cut-away portion is brought into contact with the cylinder 46, a passage communicating between the suction opening 42 and the exhaust opening 43 is formed. During the normal operation in which the purge operation is not performed, the rotor 47 is placed in this state.

Figure 2A:
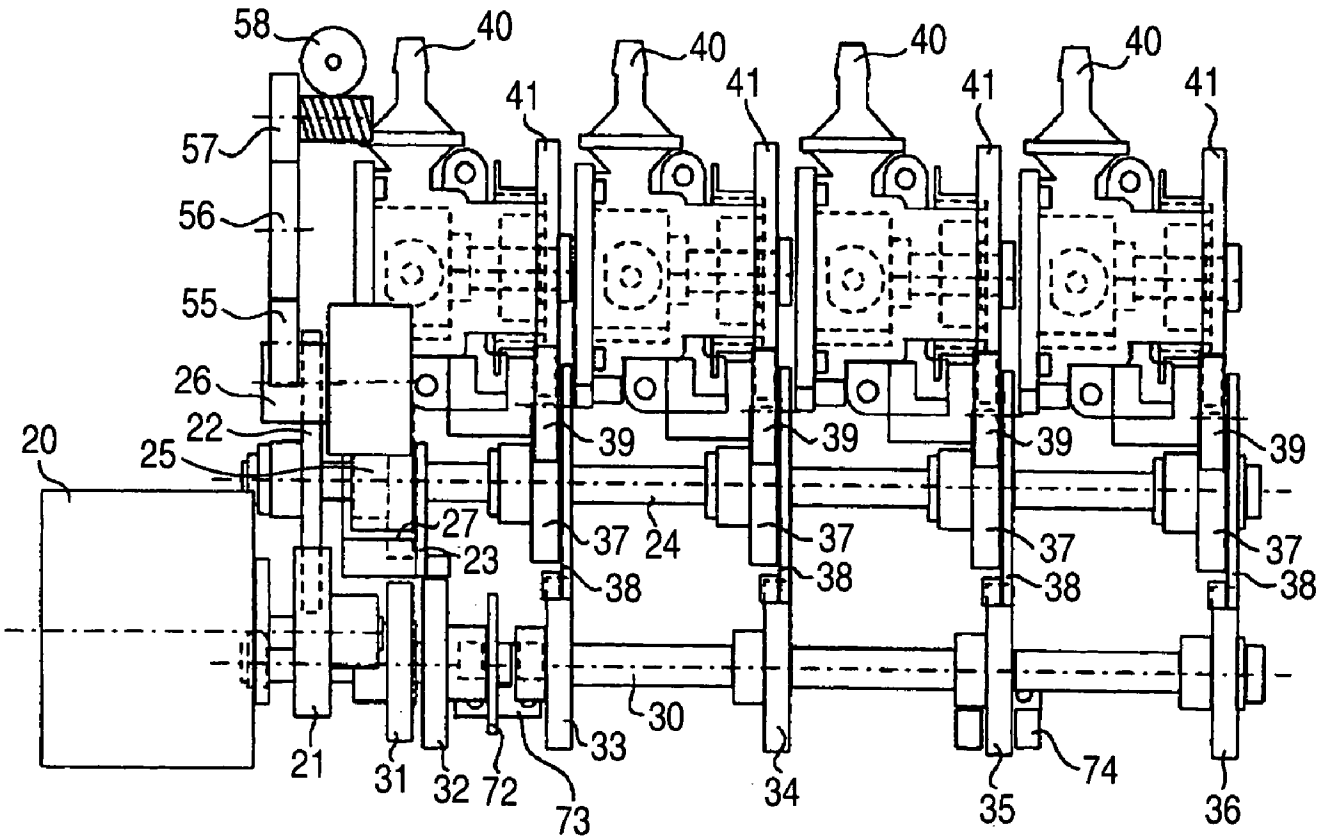
FIG. 2A is a view showing a purge portion 18 in this embodiment.
Figure 2B:
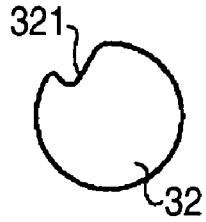
FIGS. 2B–F are end views of the columnar cams.
Figure 2C:
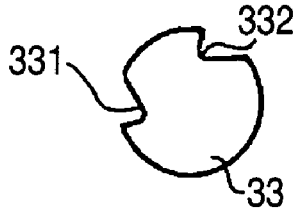
Figure 2D:
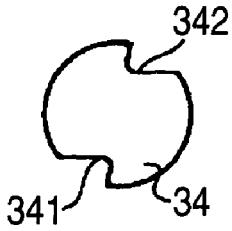
Figure 2E:
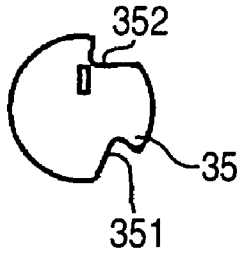
Figure 2F:
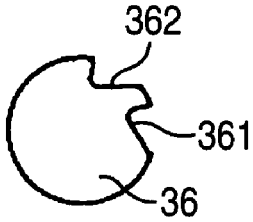
Figure 4B:
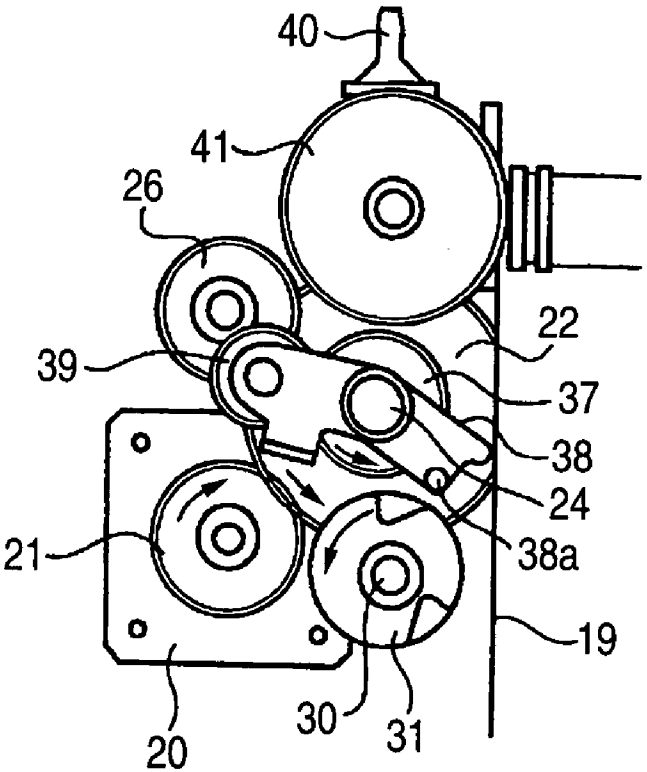
FIGS. 4A and 4B are views showing the operation of the purge portion 18 in this embodiment.
Figure 4A:
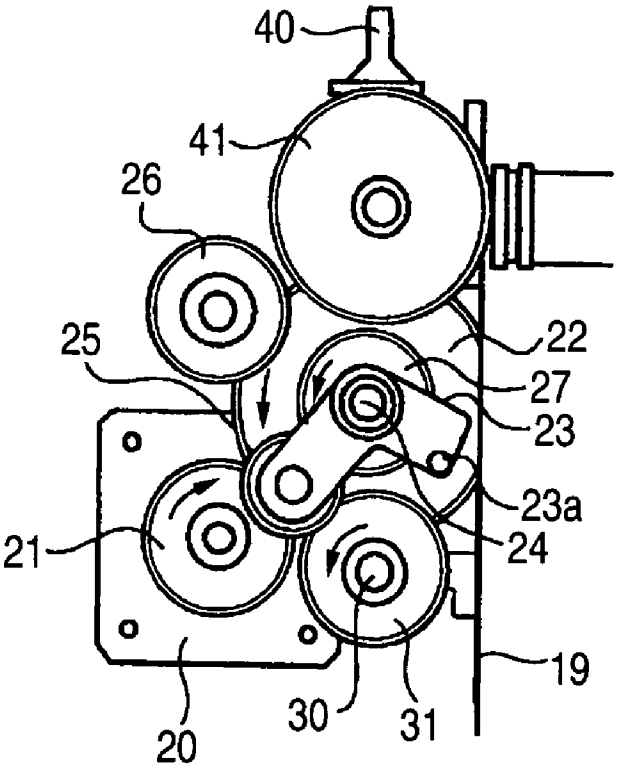

As shown in FIGS. 2A, 4A and 4B, the purge portion 18 has four pumps 40 disposed side by side to have the gears 41, which is perpendicular to the drive shaft 24. The motor 20 including a gear 21 on a drive shaft thereof and a gear 26 for transmitting a rotation force to the pickup roller 88 are disposed around the drive shaft 24.

Also, a gear 22, a sun gear 27, and four sun gears 37 are fixed to the drive shaft 24. The gear 22 engages with the gear 21 of the motor 20. The sun gear 27 transmits a power to the gear 26. The sun gears 37 transmit power to the gears 41 of the four pumps 40.

The sun gear 27 is provided with a planet gear 25 via a holding member 23 so that the planet gear 25 can rotate around the sun gear 27 in an engaging state. As shown in FIG. 4A, the planet gear 25 revolves around the sun gear 27 in the same direction as the rotation of the drive shaft 24, and moves between a position where the planet gear 25 engages with the gear 31 and a position where the planet gear 25 engages with the gear 26. Similarly, the four sun gears 37 are provided with planet gears 39 via holding members 38, so that the planet gears 37 can rotate around the sun gears 37 in the engaging state. As shown in FIG. 4B, the planet gear 39 revolves around the sun gear 37 in the same direction as the rotation of the drive shaft 24, and moves between a position where the planet gear 39 engages with the gear 41 and a position where the plane gear 39 is detached from the gear 41. Incidentally, the holding member 23 includes a protrusion portion 23*a* protruding from a portion held by the sun gear 27 in a direction opposite to the planet gear 25. Also, the holding member 38 includes a protrusion portion 38*a* in a similar manner.

Also, a selection shaft 30 is disposed in parallel to the drive shaft 24. A gear 31, which is engaged with the planet gear 25 when the planet gear 25 revolves around the sun gear 27 and moves downward, is fixed to the selection shaft.

Moreover, the columnar cams 32, 33, 34, 35 and 36 are fixed to the selection shaft 30 to face the sun gear 27 and the four sun gears 37. Also, a slit plate 72 is fixed to the selection shaft 30 between the cams 32 and 33

The cams 32, 33, 34, 35 and 36 have columnar shape and are includes first cam faces 331, 341, 351 and 361 of concave shape at positions shifted by every 60 degrees in order on the circular outer faces thereof as shown in FIGS. 2B to 2F, when viewed from the right side of FIG. 2A. Also, the cams 33, 34, 35 and 36 include second cam faces 332, 342, 352 and 362 of concave shape at the same angles.

Figure 2G:
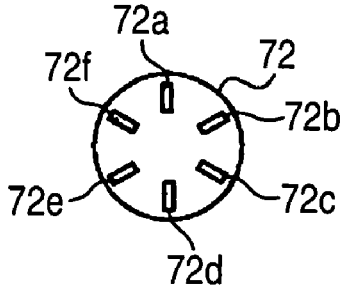
FIG. 2G is an end view of a slit plate.

Also, as shown in FIG. 2G, the slit plate 72 defines six square slits (72*a* to 72*f*) at every 60 degrees on a circular plate. The cam 35 includes one similar slit. It is noted that the slit of the cam 35 has the same phase in rotation as the slit 72*a* of the slit plate 72.

Also, the purge portion 18 has a pair of overhang portions facing each other on a surface of the slit plate 72. One overhang portion includes a light emitting element and the other overhang portion includes a light receiving element. A rotation detector 73 for detecting passage of the slits formed in the slit plate 72, and a rotation detector 74 for detecting passage of the slit formed in the cam 35, like the rotation detector 73, are provided. Incidentally, the rotation detector 73 and the rotation detector 74 output signals corresponding to intensity of light beams, which are emitted from the light emitting element to the rotation detectors 73 and 74 and are received by the light receiving element. That is, when the emitted light beam passes through the slits formed in the slit plate 72 and the came 35, the rotation detectors 73 and 74 output a signal of large value, respectively.

Also, the rotation of the gear 26 is transmitted via the gears 55, 56 and 57 to the gear 58.

According to the above configuration, the rotation force of the motor 20 can be transmitted via a simple power transmission mechanism including the sun gears 27, 27, the holding portions 23, 38 and the planet gears 25, 39.

An operation of the purge portion 18 will be described below.

First of all, when the motor 20 rotates clockwise as viewed from the right side of FIG. 2A, the gear 21 rotates the gear 22, so that the drive shaft 24 is rotated counterclockwise. At this time, as shown in FIG. 4A, the sun gear 27 is rotated along with the drive shaft 24; the holding member 23 is rotated counterclockwise around the sun gear 27, together with the planet gear 25, so that the planet gear 25 engages with the gear 31. Then, the sun gear 27 rotates the planet gear 25 to thereby cause the gear 31 engaged with the planet gear 25 to rotate, so that the selection shaft 30 is rotated counterclockwise. Also, as shown in FIG. 4B, the four sun gears 37, the planet gears 39 and the holding members 38 are rotated counterclockwise. However, since the protrusion portion 38*a* of the holding member 38 abuts against a wall face of the housing 19, the holding member 38 is stopped halfway, and the planet gear 39 idles.

Figure 5C:
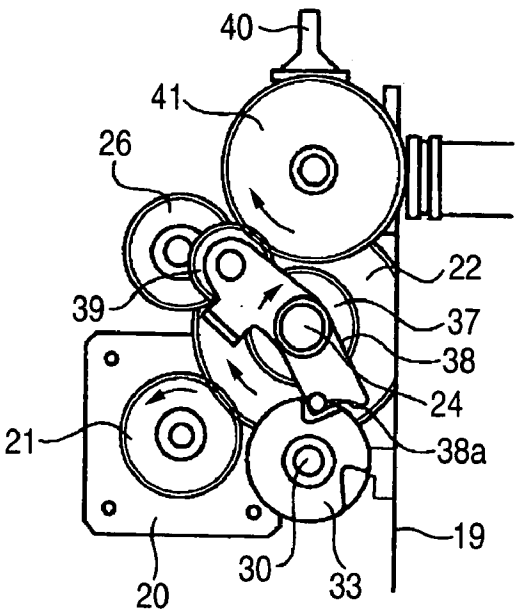
FIGS. 5A–5C are views showing the operation of the purge portion 18 in this embodiment.

When the motor 20 rotates counterclockwise, the gear 21 rotates the gear 22, so that the drive shaft 24 is rotated clockwise. At this time, as shown in FIG. 5A, the sun gear 27 is rotated along with the drive shaft 24, and the holding member 23 is rotated clockwise around the sun gear 27 together with the planet gear 25, so that the protrusion portion 23*a* of the holding member 23 abuts against the cam 32. At this time, if the protrusion portion 23*a* abuts against the outside periphery of the cam 32, the holding member 23 cannot rotate the planet gear 25 so that the planet gear 25 is meshed with the gear 26. Therefore, the planet gear 25 idles.

Figure 5B:
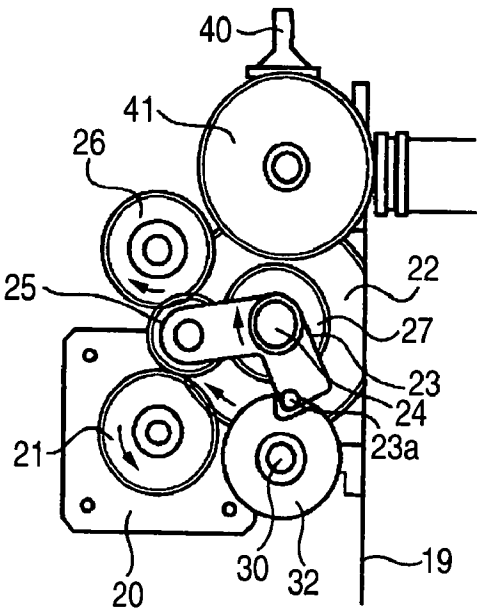
Figure 5A:
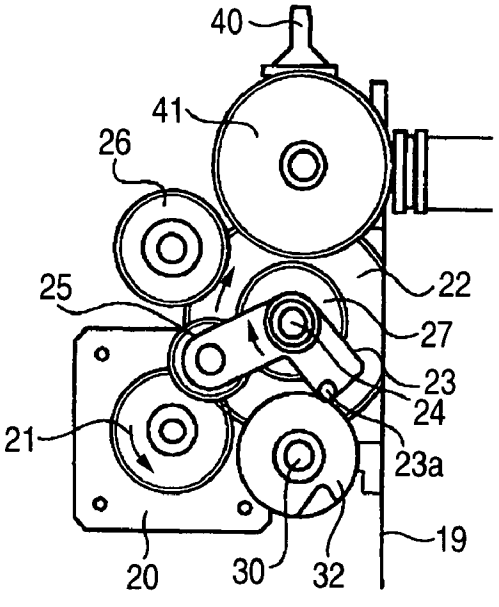

On the contrary, as shown in FIG. 5B, if the selection shaft 30 is rotated to bring a third cam face 321 of a concave shape in the cam 32 to a position contacted by the protrusion portion 23*a* of the holding member 23, the holding member 23 is rotated by the concave of the cam 32 so that the planet gear 25 engages with the gear 26. Then, the gear 26 engaged with the planet gear 25 is rotated clockwise, and the gear 58 is rotated via the gears 55, 56 and 57. As a result, the pickup roller 88 is driven and rotated.

Also, when the drive shaft 24 is rotated clockwise, the planet gear 39 likewise revolves around each of four sun gears 37. At this time, when the protrusion portion 38*a* of the holding member 38 abuts against the outer peripheral face of the cams 33, 34, 35 and 36, the planet gear 39 does not engage with the gear 41. However, as shown in FIG. 5C, if the first cam face 331, 341, 351, 361 or the second cam face 361 of the cams 33, 34, 35, 36 is brought to the position contacted by the protrusion portion 38*a* of the holding member 38, the corresponding planet gear 39 engages with the gear 41 so that the pump 40 is driven.

Figure 6:
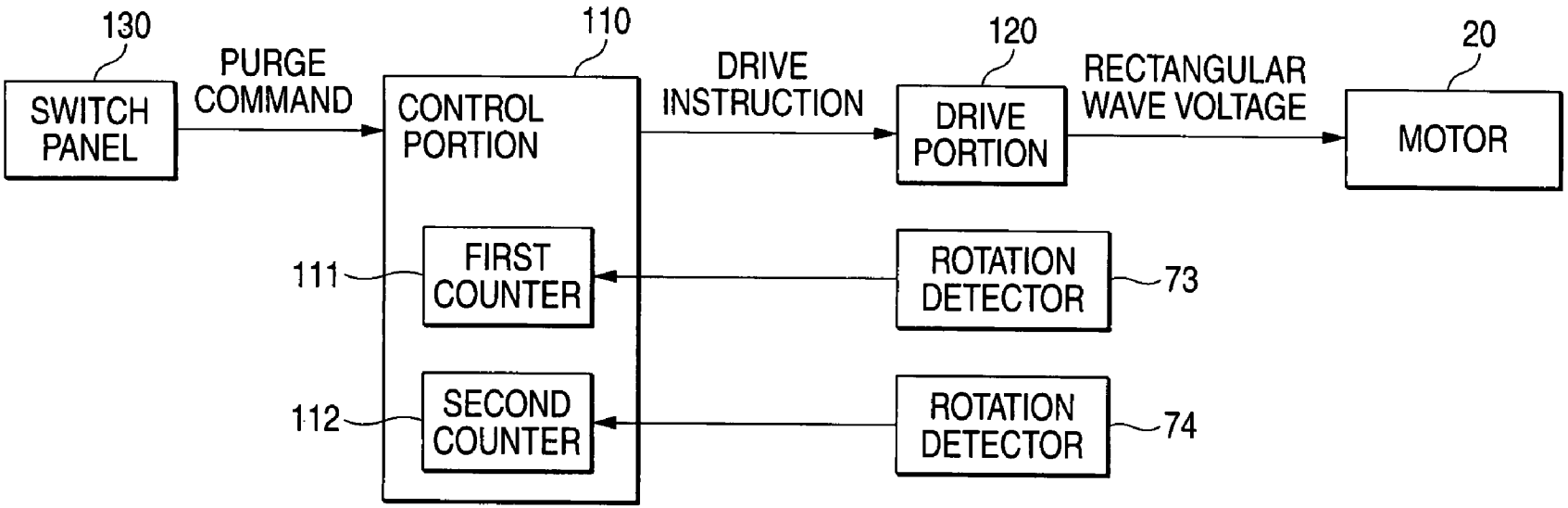
FIG. 6 is a block diagram showing the purge portion 18 in this embodiment.

Also, as shown in FIG. 6, the purge portion 18 includes a switch panel 130 for instructing the purge operation, the motor 20, a drive portion 120 for driving the motor 20, the rotation detectors 73 and 74, and the control portion 110.

The motor 20 is a step motor, which is rotated by an angle according to number of pulses in an input rectangular wave voltage.

Also, the drive portion 120 outputs a rectangular wave voltage for driving the motor 20 in a direction according to a drive instruction from the control portion 110, while the drive instruction is being input.

Also, the switch panel 130 includes a button for designating the inkjet head 11 of the color for which the purge operation is performed. When a user presses the button, an instruction for performing the purge operation for the inkjet head 11 designated by its button is issued to the control portion 110.

Also, the control portion 110 includes a well-known microcomputer, which accepts an instruction from the switch panel 130, and issues the drive instruction of the motor 20 to the drive portion 120. Also, the control portion 110 adjusts a discharge amount of ink from the inkjet head 11, and controls an operation of the drive roller 61.

The control portion 110 includes a first counter 111 for counting number of times that the signal received from the rotation detector 73 exceeds a predetermined level, and a second counter 112 for counting number of times that the signal received from the rotation detector 74 exceeds a predetermined level.

Incidentally, for the pickup roller 88 and the four pumps 40, the pickup roller 88 is assigned the mode number "1", and the pumps 40 are assigned the mode numbers "2" to "5" in the order from the left side in FIG. 2A. An instruction of the purge operation on the switch panel 130 or an operation instruction of the pickup roller 88 uses those mode numbers. Also, when the purge operation is performed for all the four pumps 40, the mode number "6" is instructed. These mode numbers "1" to "6" correspond to six slits of the slit plate 72.

In the above configuration, the pumps 40 and the pickup roller 88 are not operated at the same timing. Therefore, it is not necessary for the motor 20 to have the capacity for driving the both of the pumps 40 and the pickup roller 88. As a result, the drive source is not increased in the size.

Figure 7:
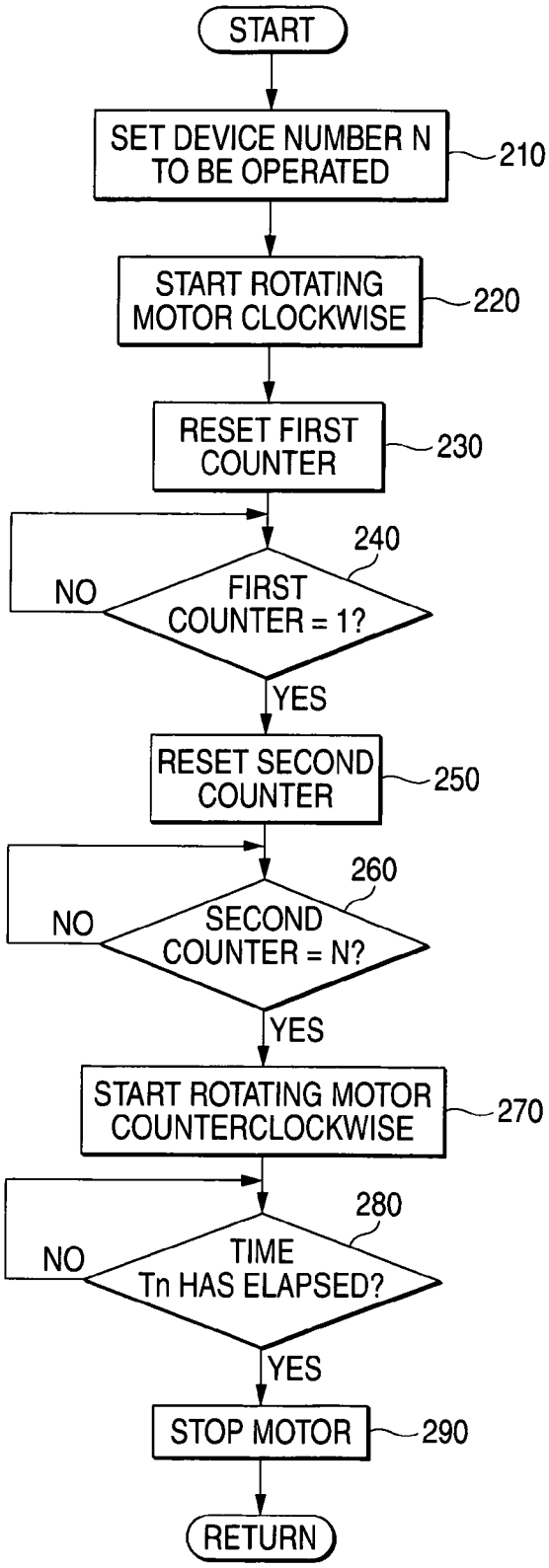
FIG. 7 is a flowchart for explaining the purge operation of a control portion 110 in this embodiment.

A processing procedure of the control portion 110 when an instruction from the switch panel 130 is input or when the pickup roller 88 is operated in performing the printing on the sheet of paper P will be described with reference to FIG. 7.

First of all, at step S210, the mode number of the device to be operated is read.

At step S220, the drive instruction is output to the drive portion 120 to rotate the motor 20 clockwise. Thereby, the planet gear 25 engages with the gear 31 so that the drive shaft 30 is rotated counterclockwise.

At step S230, the value of the second counter 112 is reset to "0".

At step S240, a determination is made whether or not the read value of the second counter 112 is equal to "1". If the value of the second counter 112 is "1", the control portion 110 concludes that the cam 35 comes to a reference position for counting the rotational angle and the procedure proceeds to step S250. If not, the step S240 is repeated. Thereby, the rotational angle position of the selection shaft 30 at a time of detecting the single slit formed on the cam 35 is set as the reference position.

At step S250, the value of the first counter 111 is reset to "0".

At step S260, a determination is made whether or not the read value of the first counter 111 is equal to the mode number set at step S210. As a result of determination, if the value of the first counter 111 is equal to the mode number, a concave on the cam face of the cam, which selects the device to be operated from among the cams 32, 33, 34, 35 and 36, can accept the protrusion portion 23*a* or 38*a*. Then, it is judged that the instructed device is operable and the procedure proceeds to step S270. If the value of the first counter 111 is not equal to the mode number, the step S260 is repeated until the value of the first counter 111 becomes equal to the mode number. For example, in the case where the mode number "3" is designated, the protrusion portion 38*a* of the holding member 38 is fitted into a concave on the first cam face 341 of the cam 34 when the value of the first counter becomes equal to "3".

At step S270, the drive instruction is output to the drive portion 120 to rotate the motor 20 counterclockwise. Thereby, the drive portion 24 is rotated clockwise to cause each of the planet gears 25 and 39 to revolve clockwise. At this time, of the holding members 23 and 38 for holding the planet gears 25 and 39, only the cam face of the cam corresponding to the designated mode number accepts the protrusion portion of the holding member to transmit the power to the device having the designated mode number, but not to transmit the power to other devices. Therefore, the designated pump 40 or the pick up roller 88 is driven.

Then, a determination is made whether or not the time since the motor 20 rotates backward (counterclockwise) reaches a preset time. If the preset time has elapsed, the procedure proceeds to step S290. If the preset time has not elapsed, the step S290 is repeated until the preset time elapsed. This preset time indicates the purge time in the case of the pump 40, or the rotation time for feeding the paper in the case of the pickup roller 88. Therefore, the operation waits for the time corresponding to the operated device to elapse.

At step S290, a drive instruction for stopping the motor 20 is output to the drive portion 120. Then, this processing is ended.

As described above, in the inkjet printer 1, the motor 20 is driven in accordance with an instruction for operating the pump 40 or the pickup roller 88, so that the drive shaft 24 is rotated counterclockwise to enable the selection shaft 30 to come to the rotational angle corresponding to the designated mode number and to select the planet gear 25 or any one of the four planet gears 39 for transmitting the power. Thereafter, the motor 20 is driven backward to rotate the drive shaft 24 clockwise, so that the designated pump 40 or the pickup roller 88 is operated. A table 1shows a correspondence relation between the mode number "1" to "6" and the first, second, third cam faces 321, 331, 332, 341, 342, 351, 352, 361, 362.

TABLE 1

| Mode number | Cam Face |
|---|---|
| 1 | 3rd cam face 321 |
| 2 | 2nd cam face 331 |
| 3 | 2nd cam face 341 |
| 4 | 2nd cam face 351 |
| 5 | 2nd cam face 361 |
| 6 | 1st cam faces 332, 342, 352, 362 |

In this manner, the purge operation is performed for any selected one of the inkjet heads 11 requiring the purge operation, using the single motor 20. If the mode number "1" is set, the motor 20 is used to drive the pickup roller 88, but not used for the purge operation.

Also, the purge operation is performed not only for the inkjet heads 11 individually, but also for all the inkjet heads 11 at the same time, if the mode number "6" is set. This is because the second cam faces 332, 352 and 362 of the cams 33, 34, 35 and 36 are formed to have the same phase in rotation.

(Another Embodiment)

An inkjet printer according to another embodiment of the invention will be described with reference to FIG. 8.

Figure 8:
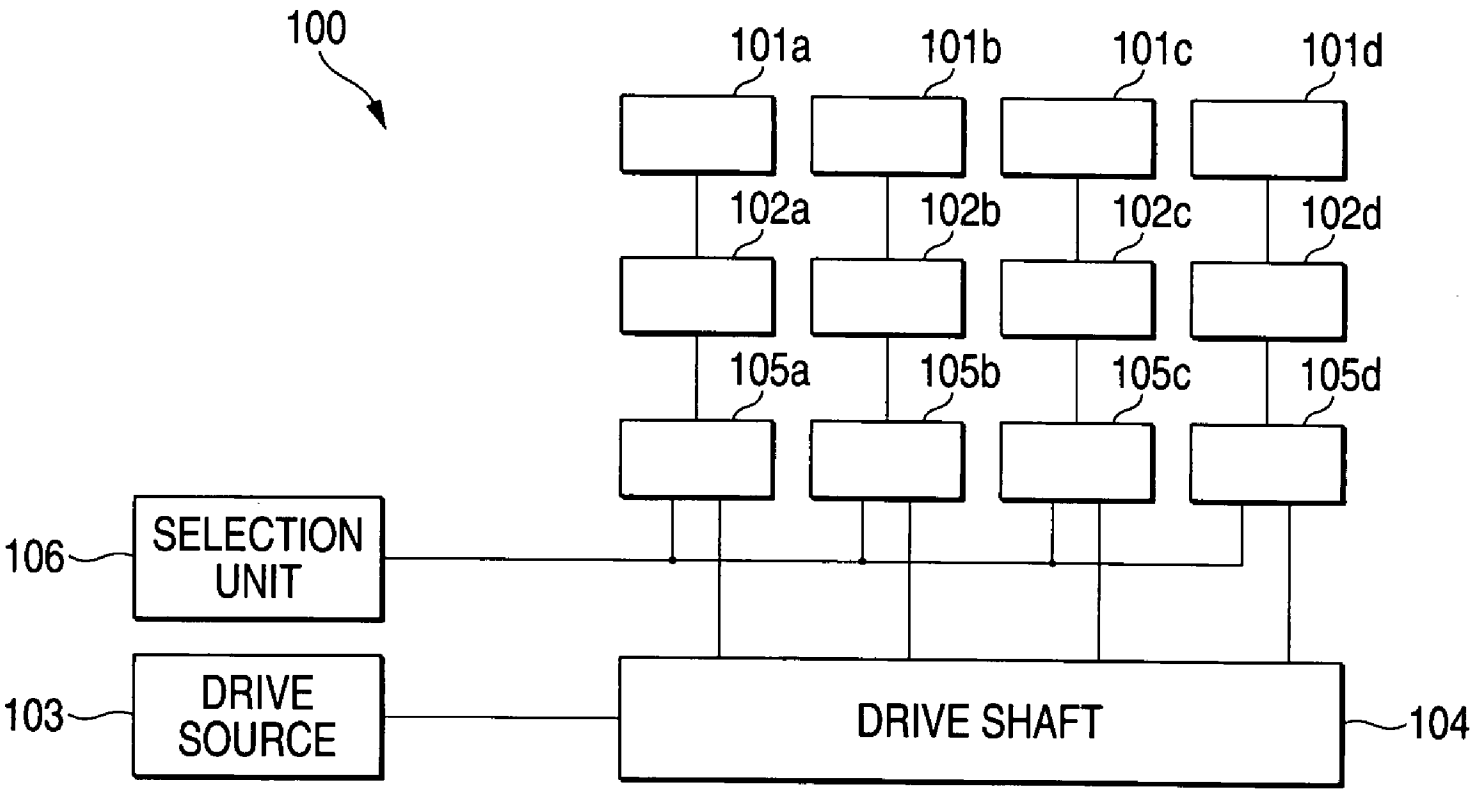
FIG. 8 is a block diagram of an inkjet printer 100.

FIG. 8 shows a block diagram of an inkjet printer 100. The inkjet printer 100 includes a plurality of inkjet heads 101 (101*a* to 101*d*), a plurality of pumps 102 (102*a* to 102*d*), a drive source 103, a drive shaft 104, a plurality of power transmission mechanisms 105 (105*a* to 105*d*), and a selection unit 106. The inkjet heads 101 eject ink to form an image on a recording medium (e.g. a sheet of paper P), respectively. The pumps 102 supply the ink to the inkjet heads 101 to recover an ejection condition of the ink of the inkjet heads 101. The drive source 103 rotates the drive shaft 104 forward or backward. The power transmission mechanisms 105 are disposed between the drive shaft 104 and the pumps 102, respectively. The power transmission mechanisms 105 switch between two states. One is a state where a forward rotation force of the drive shaft 104 is transmitted to each pump 102 to bring each pump 102 in an operatable condition. The other is a state where the forward rotation force of the drive shaft 104 is not transmitted to each pump 102. In conjunction with reverse rotation of the drive shaft 104, the selection unit 106 selects at least one of the power transmission mechanisms 105. The selected power transmission mechanism 105 is brought into a state where the selected power transmission mechanism 105 transmits the forward rotation force of the drive shaft 104. In FIG. 8, numbers of the inkjet heads 101, the pumps 102, and the power transmission mechanisms 105 are four, respectively. However, the invention is not limited thereto. The inkjet printer 100 may include desirable numbers of the inkjet heads 101, the pumps 102, and the power transmission mechanisms 105.

With this inkjet printer 100, when the drive shaft 104 is backward rotated, the selection unit 106 selects at least one of the power transmission mechanisms 105 to be brought into a state where the selected power transmission mechanism 105 transmits the forward rotation force of the drive shaft 104. When the drive shaft 104 is rotated forward, the power transmission mechanism 105 selected by the selection unit 106 operates the corresponding pump 102.

Therefore, when one of the inkjet heads 101 is clogged, the power transmission shaft 105 is rotated backward via the drive source 103 to select the power transmission mechanism 105 corresponding to the pump 102. Thereafter, the drive shaft 104 is rotated backward to drive the pump 102 corresponding to the selected power transmission mechanism 105. Thereby, the purge operation is performed only for the clogged inkjet head 101.

In this manner, in the inkjet printer 100, at least one of the plurality of inkjet heads 101 is arbitrarily selected using a single drive source 103 and the purge operation is performed for the selected inkjet head 101.

In addition to a case where desired inkjet head 101 is selected from among the plurality of inkjet heads 101 and the purge operation is performed for the selected inkjet head 101, when the inkjet printer 100 is not in use for the long term and there is a possibility that all the inkjet heads are clogged, the purge operation for all the inkjet heads may be performed. In this case, the inkjet heads 101 maybe individually selected and the purge operation is performed in sequence. However, if all the inkjet heads 101 can be selected and the purge operations therefor are performed at the same time, the processing time is shortened.

Though the embodiment of invention has been described above, this invention is not limited to the above specific embodiment, but various modifications may be made thereto.

For example, in this embodiment, the purge operation is performed in accordance with an instruction from the switch panel 130, but may be performed upon a request from other portions, for example, an instruction may be entered from an external personal computer, or the control portion 110 may determine the elapsed time since the previous purge operation and automatically perform the purge operation if a preset time has elapsed. This elapsed time may be determined for each head (each color of the ink). Particularly, when the printing is performed in monochrome or specific color ink for a long time, the unused inkjet heads may be only purged, though all the inkjet heads were conventionally purged collectively. In this embodiment, the elapsed time is managed for each ink color (head) to allow the specific head alone to be purged, whereby the ink is prevented from being wasted.

The motor 20 may drive devices such as the drive roller 61, in place of the pickup roller 88, in which other devices may be provided with the sun gear 27, the planet gear 25, the holding member 23 and the cam 32 to be driven in addition to the pickup roller 88. Also, another gear may be further fixed to the selection shaft 30 to transmit a counterclockwise rotation of the selection shaft 30 to other devices.

Also, the cams 32, 33, 34, 35 and 36 may be replaced with the following configuration. For example, the selection shaft 30, which is rotated together with the counterclockwise rotation of the drive shaft 24, may be formed with an axially spiral groove on its circumferential face, whereby a selector may be fitted into the spiral groove, and moved axially together with the rotation of the selection shaft 30 to select the power transmission mechanism.

Also, the inkjet printer 1 uses the inkjet heads 11 with the ejection ports arranged over the width of the paper, but may perform the printing by causing the inkjet nozzles to scan in the cross direction of the paper. When the inkjet printer 11 has a large quantity of ink per discharge as in this embodiment, there is the great effect that the purge operation can be performed by using the required inkjet heads 11 alone.

The embodiments are on the presumption that the inkjet heads 11, 101 eject cyan, magenta, yellow, black, respectively. However, the invention is not limited thereto. Specifically, the invention may be applied to an inkjet printer including inkjet heads ejecting two kinds of ink, respectively. The two kinds of ink may be dye ink and pigment ink of the same color, black ink and gray ink, or cyan ink and light cyan ink (used for printing photo).

Furthermore, the number of kinds of ink is not limited to plural number. A single kind of ink may be used in the inkjet printer. In this case, the inkjet heads may have different resolutions from each other; the inkjet heads may have different in diameter of ejected ink droplet from each other; or the inkjet heads may be of the same type and be arranged in the sub-scanning direction at a predetermined interval.

What is claimed is:

1. An inkjet printer comprising:

a plurality of inkjet heads which eject ink to form an image on a recording medium, respectively;

a plurality of pumps which supply the ink to the inkjet heads;

a drive source;

a first drive shaft rotated forward or backward by the drive source;

a plurality of first power transmission mechanisms which are disposed between the first drive shaft and the pumps, respectively and switch between a state where a forward rotation force of the first drive shaft is transmitted to each pump to bring each pump in a operable condition and a state where the forward rotation force of the first drive shaft is not transmitted to each pump; and a selection unit which, in conjunction with a backward rotation of the first drive shaft, selects at least one of the first power transmission mechanisms to be brought into a state where the selected first power transmission mechanism transmits the forward rotation force of the first drive shaft;

a second drive shaft which rotates in a reverse direction of the rotation of the first drive shaft in conjunction with the rotation of the first drive shaft, wherein:

each of first power transmission mechanisms includes:

a sun gear which rotates together with the rotation of the first drive shaft;

a planet gear which revolves around the sun gear while engaging with the sun gear; and a holding member which holds the plane gear between a operation position where the planet gear engages with a gear, which rotates together with a rotation shaft of the corresponding pump to transmit the forward rotation force of the first drive shaft to the corresponding pump, and a retraction position where the planet gear retracts from the operation position;

the selection unit includes a plurality of cams for each first power transmission mechanism, the cams disposed on the second drive shaft;

each of holding members of the first power transmission mechanisms abuts against each of cams; and when a rotation position of the second drive shaft is in predetermined angle ranges, which are assigned to the first power transmission mechanisms, respectively, each of cams moves each of holding members of the first power transmission mechanisms from the retraction position to the operation position.

2. The inkjet printer according to claim 1, wherein the selection unit selects one of the first power transmission mechanisms or all of the first power transmission mechanisms.

3. The inkjet printer according to claim 1, wherein each of inkjet heads includes a plurality of ejection ports, which are arranged in a direction perpendicular to a transporting direction of the recording medium.

4. The inkjet printer according to claim 1, further comprising:

a second power transmission mechanism which transmits the forward rotation force of the first drive shaft to a driven device other than the pumps to operate the driven device, wherein:

the second power transmission mechanisms includes:

a sun gear which rotates together with the rotation of the first drive shaft;

a planet gear which revolves around the sun gear while engaging with the sun gear; and a holding member which holds the plane gear between a operation position where the planet gear engages with a gear, which rotates together with a rotation shaft of the driven device to transmit the forward rotation force of the first drive shaft to the driven device, and a retraction position where the planet gear retracts from the operation position;

the selection unit further includes a cam for the second power transmission mechanism, the cam for the second power transmission mechanism disposed on the second drive shaft;

the holding member of the second power transmission mechanism abuts against the cam for the second power transmission mechanism; and when the rotation position of the second drive shaft is in predetermined angle ranges, which are assigned to the first power transmission mechanisms and the second power transmission mechanism, respectively, each of cams moves each of holding members from the retraction position to the operation position.

5. The inkjet printer according to claim 1, wherein the inkjet heads eject the ink, which are different colors from each other.

6. An inkjet printer comprising:

a plurality of inkjet heads which eject ink to form an image on a recording medium, respectively;

a plurality of pumps which supply the ink to the inkjet heads;

a drive source;

a first drive shaft rotated forward or backward by the drive source;

a plurality of first power transmission mechanisms which are disposed between the first drive shaft and the pumps, respectively and switch between a state where a forward rotation force of the first drive shaft is transmitted to each pump to bring each pump in a operable condition and a state where the forward rotation force of the first drive shaft is not transmitted to each pump; and a selection unit which, in conjunction with a backward rotation of the first drive shaft, selects at least one of the first power transmission mechanisms to be brought into a state where the selected first power transmission mechanism transmits the forward rotation force of the first drive shaft, further comprising:

a control unit, wherein:

when the control unit receives an instruction for operating at least one of the pumps from an external, the control unit causes the first drive shaft to rotate backward on the basis of the instruction and a preset amount of the backward rotation of the first drive shaft so as to cause the selection unit to select the at least one of the first power transmission mechanisms corresponding to the pump to be operated; and thereafter, the control unit causes the first drive shaft to rotate forward so that the pump to be operated operates to supply the ink to the corresponding inkjet head.

7. An inkjet printer comprising:

a plurality of inkjet heads which eject ink to form an image on a recording medium, respectively;

a plurality of pumps which supply the ink to the inkjet;

a drive source;

a first drive shaft rotated forward or backward by the drive source;

a plurality of first power transmission mechanisms which are disposed between the first drive shaft and the pumps. respectively and switch between a state where a forward rotation force of the first drive shaft is transmitted to each pump to bring each pump in a operable condition and a state where the forward rotation force of the first drive shaft is not transmitted to each pump; and a selection unit which, in conjunction with a backward rotation of the first drive shaft, selects at least one of the first power transmission mechanisms to be brought into a state where the selected first power transmission mechanism transmits the forward rotation force of the first drive shaft, further comprising:

a second power transmission mechanism which transmits the forward rotation force of the first drive shaft to a driven device other than the pumps to operate the driven device, wherein:

the selection units select the at least one of the first power transmission mechanisms or the second power transmission mechanism.

8. The inkjet printer according to claim 7, wherein the driven device includes a pickup roller which supplies the recording medium to an image formation position where the inkjet heads are disposed.

* * * * *